US007033276B2

(12) United States Patent
Walker et al.

(10) Patent No.: US 7,033,276 B2
(45) Date of Patent: Apr. 25, 2006

(54) METHOD AND SYSTEM FOR ADAPTING CASINO GAMES TO PLAYING PREFERENCES

(75) Inventors: Jay S. Walker, Ridgefield, CT (US); James A. Jorasch, New York, NY (US); Thomas M. Sparico, Riverside, CT (US)

(73) Assignee: Walker Digital, LLC, Stamford, CT (US)

( * ) Notice: Subject to any disclaimer, the term of this patent is extended or adjusted under 35 U.S.C. 154(b) by 383 days.

(21) Appl. No.: 09/962,065

(22) Filed: Sep. 25, 2001

(65) Prior Publication Data

Related U.S. Application Data

(63) Continuation-in-part of application No. 09/768,567, filed on Jan. 24, 2001, now Pat. No. 6,425,828, and a continuation-in-part of application No. 09/481,204, filed on Jan. 11, 2000, now Pat. No. 6,293,866, said application No. 09/481,204 is a continuation of application No. 08/775,388, filed on Dec. 30, 1996, now Pat. No. 6,110,041, said application No. 09/768,567 is a continuation of application No. 09/028,781, filed on Feb. 24, 1998, now Pat. No. 6,224,486, which is a continuation of application No. 08/635,576, filed on Apr. 22, 1996, now Pat. No. 5,779,549.

(51) Int. Cl.
*A63F 9/24* (2006.01)

(52) U.S. Cl. ..... 463/40

(58) Field of Classification Search ..... 463/16–22, 463/11–13, 23, 25, 29, 30, 40, 41, 42, 43, 463/35; 273/143 R, 138.1, 139
See application file for complete search history.

(56) References Cited

U.S. PATENT DOCUMENTS

| | | | | |
|---|---|---|---|---|
| 4,586,707 | A | 5/1986 | McNeight et al. | 273/1 R |
| 4,592,546 | A | 6/1986 | Fascenda et al. | 273/1 E |
| 4,760,245 | A | 7/1988 | Fukaya | |
| 4,764,666 | A | 8/1988 | Bergeron | 235/380 |
| 4,880,237 | A | 11/1989 | Kishishita | 273/138 A |
| 5,083,271 | A | 1/1992 | Thacher et al. | 364/411 |
| 5,083,800 | A | 1/1992 | Lockton | 273/439 |
| 5,108,115 | A | 4/1992 | Berman et al. | 273/439 |
| 5,114,155 | A | 5/1992 | Tillery et al. | 273/371 |
| 5,127,044 | A | 6/1992 | Bonito et al. | 379/88 |
| 5,132,900 | A | 7/1992 | Gilchrist et al. | 364/419 |
| 5,213,337 | A | 5/1993 | Sherman | 273/439 |
| 5,283,734 | A | 2/1994 | Von Kohorn | 364/412 |
| 5,359,510 | A | 10/1994 | Sabaliauskas | 364/410 |
| 5,370,399 | A | 12/1994 | Lilverance | 273/434 |
| 5,429,361 | A | 7/1995 | Raven et al. | 273/138 A |

(Continued)

FOREIGN PATENT DOCUMENTS

DE 42 22 896 A1 1/1994

(Continued)

OTHER PUBLICATIONS

Microsoft Windows, "Solitaire", 1981.

(Continued)

*Primary Examiner*—Kim Nguyen
(74) *Attorney, Agent, or Firm*—Magdalena M. Fincham

(57) ABSTRACT

One embodiment of the present invention provides for receiving a player identifier, transmitting the player identifier to a central server, receiving data corresponding to the player identifier from the central server, and configuring play of a casino game based on the data.

21 Claims, 13 Drawing Sheets

U.S. PATENT DOCUMENTS

| | | | | | |
|---|---|---|---|---|---|
| 5,459,825 | A | | 10/1995 | Anderson et al. | 395/133 |
| 5,544,892 | A | | 8/1996 | Breeding | 273/292 |
| 5,546,523 | A | | 8/1996 | Gatto | 395/156 |
| 5,558,339 | A | | 9/1996 | Perlman | 463/42 |
| 5,561,811 | A | | 10/1996 | Bier | 395/825 |
| 5,593,349 | A | | 1/1997 | Miguel et al. | 463/30 |
| 5,637,844 | A | | 6/1997 | Eiba | 235/375 |
| 5,639,088 | A | * | 6/1997 | Schneider et al. | 273/138.2 |
| 5,643,088 | A | | 7/1997 | Vaughn et al. | 463/40 |
| 5,741,183 | A | | 4/1998 | Acres et al. | 463/42 |
| 5,770,533 | A | * | 6/1998 | Franchi | 463/42 |
| 5,779,549 | A | * | 7/1998 | Walker et al. | 463/42 |
| 5,813,913 | A | | 9/1998 | Berner et al. | 463/40 |
| 5,816,917 | A | | 10/1998 | Kelmer et al. | 463/16 |
| 5,816,918 | A | | 10/1998 | Kelly et al. | 463/16 |
| 5,833,540 | A | * | 11/1998 | Miodunski et al. | 463/42 |
| 5,855,516 | A | | 1/1999 | Eiba | 463/42 |
| 5,859,416 | A | | 1/1999 | Gatto | 235/384 |
| 5,871,398 | A | | 2/1999 | Schneier et al. | 463/16 |
| 5,945,988 | A | * | 8/1999 | Williams et al. | 715/747 |
| 5,983,200 | A | | 11/1999 | Slotznick | 705/26 |
| 6,110,041 | A | | 8/2000 | Walker et al. | 463/20 |
| 6,224,486 | B1 | | 5/2001 | Walker et al. | 463/42 |
| 6,254,483 | B1 | * | 7/2001 | Acres | 463/26 |
| 6,287,201 | B1 | | 9/2001 | Hightower | 463/41 |
| 6,293,866 | B1 | | 9/2001 | Walker et al. | 463/20 |

FOREIGN PATENT DOCUMENTS

| | | |
|---|---|---|
| EP | 0 843 272 A1 | 5/1998 |
| GB | 2 167 676 A | 6/1986 |
| WO | WO 94/01839 | 1/1994 |
| WO | WO 96/07867 | 3/1996 |

OTHER PUBLICATIONS

"Casino's Computers Keep Tabs on Losers", Chicago Tribune, Oct. 2, 1985, Section: Business, p. 14, Zone C.

Fisher, Harvey, "Casino Law Ends Cash Rebates For Big-Time Losers", The Record, Jan. 15, 1988, Section: News, p. A05.

Kent, Bill, "New Boardwalk Barter; Atlantis Introduces A Token as Enticement", The Record, Jul. 22, 1988, Section: Lifestyle/Previews, p. 032.

Raphel, Murray, "Casinos gamble on direct mail: Atlantic City casinos; Retail; Industry Overview", Direct Marketing Magazine, Feb. 1992, Section: vol. 54, No. 10, p. 32, ISSN: 0012-3188.

Freedman, David H., "Odds Man In", Forbes, Oct. 25, 1993, Section: Forbes ASAP, Quick Studies, p. 33.

Franklin, Stephen, "Pinball Power Puts Money Into The Slots", Chicago Tribune, May 9, 1994, Section: Business, p. 1, Zone C.

Salmon-Heyneman, Jana, "Gaming propels fastest growing publicly traded firm in valley", Las Vegas Business Press, Jul. 11, 1994, Setion: vol. 11, No. 27, Sec. 1, p. 1.

Grochowski, John, "Casino Insider Offers A Guide to Freebies", Chicago Sun-Times, Aug. 12, 1994, Section: Weekend Plus, Gaming, p. 31, NC.

Troy, Timothy N., "High stakes technology; technology for guest retention management", Hotel & Motel Management, Sep. 19, 1994, Section: vol. 209, No. 16, p. 27, ISSN: 0018-6082.

Troy, Timothy, N., "Flexibility a key for vendors betting on casinos; Micros Systems Inc.'s 8700 point-of-sale system", Hotel & Motel Management, Sep. 19, 1994, Section: vol. 209, No. 16, p. 27, ISSN: 0018-6082.

Grochowski, John, "Riverboat Comp Systems Cracking a Case in Point", Chicago Sun-Times, Mar. 17, 1995, Section: Weekend Plus, Gaming, p. 13.

Sherman, Debra, "Company Launches New Player Tracking System", The Reuter Asia-Pacific Business Report, Oct. 20, 1995.

Berry, Kate, "Anchor Gaming Inc.", Investor's Business Daily, May 2, 1996, Section: The New America, p. A6.

Mattox, Jake, "Huntington Press: Publishing the books on Las Vegas", Las Vegas Business Press, Sep. 16, 1996, Section: vol. 13, No. 51, p. 3.

"Open Market Announces Sale of OM-Express Desktop Software Product to DocuMagix . . . ", PR Newswire, Nov. 7, 1996, Section: Financial News.

Grochowski, John, "Comp points add up faster playing slots", Chicago Sun-Tribune, Nov. 8, 1996, Section: WKP, Gaming, p. 23, NC.

Microsoft Windows, Solitaire screens and information, (http //www microsoft com/WINDOWS2000/en/professional/help/), Download date: Mar. 19, 2001.

"Alpha Sports Games", undated.

"Contest: Worst Experience with a Salesperson" Peter Lettersee & Associates, Inc., undated.

"How to play the POOL!", Cybertainment, undated.

"The Rules", Bert & Associates, Inc., undated.

"Who's In Front Of This Behind Contest!", Roaring Mouse Entertainment, Inc., undated.

"WIN $200! From The Gate", undated.

"Yoyodyne Games", Yoyodyne Entertainment, Inc., undated.

"Word Puzzles With A Twist; Punzzles; Exercises For Your Brain", Pinnacle Solutions, Copyright 1995.

* cited by examiner

214

| PLAYER ID | SOCIAL SECURITY NUMBER | NAME | ADDRESS | CREDIT CARD NUMBER | PLAYER RATING | COMP. INFO | PLAYER PREFERENCE TRACKING NUMBER | CASINO PREFERENCE TRACKING NUMBER |
|---|---|---|---|---|---|---|---|---|
| JJ-3467 | 123-45-6789 | PLAYER A | XXX ST. XX, XX 12345 | 1111 2222 3333 4444 | HIGH ROLLER | FREQUENT COMP. RATE | HR-112 | CHR-112 |
| | | | | | | | | |
| | | | | | | | | |

FIG. 4

216

| PLAYER ID NO. | TRACKING NUMBER | GAME TYPE | LANGUAGE | SOUND OPTIONS | SPEED OF REEL SPINS | NUMBER OF COINS PLAYED AS DEFAULT | PAYOUT STRUCTURE | PAYOUT OPTIONS | FORM OF COMP. | CURRENCY |
|---|---|---|---|---|---|---|---|---|---|---|
| PLAYER ID NO. 12345 | HR-234 | VOLCANO ISLAND 2 COIN SLOT | FRENCH | MEDIUM | FAST: 110/MIN | 2 | ONLY HIGH END JACKPOTS | AT END OF PLAY | DRINKS | U.S. DOLLARS |
| PLAYER ID NO. 23456 | ACES-567 | VIDEO POKER-JACKS & UP | ENGLISH | LOUD | MEDIUM: 5 HANDS/ MINUTE | 3 | | WITH EACH HAND PLAYED | MEALS OR T-SHIRTS | U.S. DOLLARS |
| PLAYER ID NO. 34567 | | | | | | | | | | |

FIG. 5

218

| PLAYER ID NO. | HOLD PERCENTAGE | COMP. RATE | COMP. AWARD LIMITS | GAME ELIGIBILITY (LOCKOUT) | OTHER |
|---|---|---|---|---|---|
| PLAYER ID NO. 12345 | 5% | ONE EVERY THREE HOURS | ONLY DRINKS | ALL | |
| PLAYER ID NO. 23456 | 10% | ONE EVERY HOUR | ONLY DRINKS OR MEALS | LEVEL 3 | |
| PLAYER ID NO. 34567 | 7.5% | ONE EVERY DAY | NONE | NONE | |

FIG. 6

326

| GAME TYPE | LANGUAGE | SOUND | SPEED OF REEL SPIN | CURRENCY | PAYOUT TYPE | PAYOUT STRUCTURE | NO. OF COINS (DEFAULT) | FORM OF COMP. |
|---|---|---|---|---|---|---|---|---|
| 1 | A | X | 10 | $ | A1 | CUSTOM1 | 1 | MONEY |
| 2 | B | XX | 9 | LBS. | A2 | CUSTOM2 | 2 | FOOD |
| 3 | C | XXX | 8 | YEN | A3 | | 3 | DRINK |
| 4 | D | XXXX | 7 | DM | A4 | | 4 | ROOM |
| 5 | E | XXXXX | 6 | PESO | A5 | | 5 | MERCHANDISE |
| 6 | F | XXXXXX | 5 | | A6 | | 6 | FREQ. FLYER MI |
| 7 | G | XXXXXXX | 4 | | A7 | | 7 | COUPONS |
| 8 | H | XXXXXXXX | 3 | | A8 | | 8 | CREDITS |
| 9 | I | XXXXXXXXX | 2 | | A9 | | 9 | TICKETS |

FIG. 7

328

| HOLD PERCENTAGE | COMPLIMENTARY RATE | COMP. SPECIFICATIONS | GAME ELIGIBILITY (LOCKOUT) | OTHER |
|---|---|---|---|---|
| 5.75% | ONE EVERY 80 MINUTES OF PLAY | DRINKS AND FOOD ONLY | NONE | DOES NOT LIKE CHINESE FOOD |
| 7.65% | ONE EVERY 30 MINUTES OF CONTINUOUS PLAY | MERCHANDISE/ROOM | LEVEL 4 | PREFERS MARTINIS |
| | | | | |
| | | | | |

FIG. 8

METHOD AND SYSTEM FOR ADAPTING CASINO GAMES TO PLAYING PREFERENCES

The present application is a Continuation in Part of:

(i) U.S. patent application Ser. No. 09/481,204, filed Jan. 11, 2000, which issued on Sep. 25, 2001, as U.S. Pat. No. 6,293,866 B1; which is a continuation of U.S. patent application Ser. No. 08/775,388, filed Dec. 30, 1996, which issued on Aug. 29, 2000, as U.S. Pat. No. 6,110,041; and also (ii) U.S. patent application Ser. No. 09/768,567, filed Jan. 24, 2001, which issued on Jul. 30, 2002, as U.S. Pat. No. 6,425,828 B2; which is a continuation of U.S. patent application Ser. No. 09/028,781, filed Feb. 24, 1998, which issued on May 1, 2001, as U.S. Pat. No. 6,224,486 B1; which is a continuation of U.S. patent application Ser. No. 08/635,576, filed Apr. 22, 1996, which issued on Jul. 14, 1998, as U.S. Pat. No. 5,779,549.

BACKGROUND OF THE INVENTION

1. Field of the Invention

The present invention relates to gaming methods and systems. More particularly, the present invention relates to a method and system for adapting casino games to playing preferences.

2. Description of the Related Art

Many casinos offer electronic slot machines, each programmed to play a particular game of chance, such as slots, video poker, or video blackjack. While these games award payouts based upon play results, they are designed to retain, on average, a certain percentage of all money received. This percentage is commonly referred to as the "hold percentage." Despite the fact that the odds are stacked in favor of slot machines, players still play slot machines not only for their entertainment value, but also in hopes of hitting a large jackpot.

To provide an added incentive to play the slot machines, many casinos offer programs to reward those players who frequently play slot machines. In one such program, a casino accumulates "player reward points" for a player as he spends money on slot machines in that casino. This can be done by networking the slot machines to a central server that stores the points for that player. The casino issues a player tracking card containing a unique player identification number. The player inserts the card into a card reader of a slot machine, which transmits the identification number to the central server. As the player spends money in the slot machine, the server accumulates reward points for that player. After the player accumulates enough points, he can redeem them for, for example, merchandise or apply them against room, food, and beverage charges at the casino hotel.

In many cases, however, these incentives may not be enough to attract casino players to play slot machines. One reason is that players may find it difficult to locate slot machines configured to play the game they prefer. A slot machine is typically programmed to play a single game type (e.g., deuces-wild, video poker). If a player is interested in playing a game other than the game that a particular slot machine is programmed to play, he is forced to wander around the casino until he is able to locate another available slot machine programmed to play the preferred game. In addition, where a group of people visit a casino, members of the group may be forced to split up so that each can find a slot machine programmed to play the game he likes.

Even after players have successfully found slot machines programmed to play the games they like, those slot machines may not be configured to operate in a manner that they like. For example, many slot machines do not permit players to select which language is used, or choose which form of payout (i.e., money, prize, complimentary awards) the player prefers. Thus, locating slot machines configured to players' preferences presents such an imposing task that many players are simply discouraged from even trying and consequently do not play slot machines. Accordingly, conventional slot machines do not satisfy the needs of many players.

To address this shortcoming, some slot machines prompt players at the beginning of every gaming session to select from a menu of games. This, however, requires players to spend some time at the beginning of each and every gaming session choosing their preferred game, which in most cases does not vary from session to session. Many players are unwilling to spend, or uninterested in spending, the time to repeatedly enter the same game selection every time they play. Accordingly, such slot machines are also unsatisfactory.

SUMMARY OF INVENTION

One embodiment of the present invention provides for receiving a player identifier, transmitting the player identifier to a central server, receiving data corresponding to the player identifier from the central server, and configuring play of a casino game based on the data.

BRIEF DESCRIPTION OF THE DRAWINGS

The accompanying drawings are included to provide a further understanding of the invention and, together with the Detailed Description, serve to explain the principles of the invention.

In the drawings:

FIG. 4 illustrates a sample record from player database 214 stored in data storage device 210 shown in FIG. 2;

FIG. 5 illustrates a sample record from player preferences database 216 stored in data storage device 210 shown in FIG. 2;

FIG. 6 illustrates a sample record from casino preferences database 218 stored in data storage device 210 shown in FIG. 2;

FIG. 7 illustrates, a sample table from game parameter database 326 stored in data storage device 320 shown in FIG. 3;

FIG. 8 illustrates a sample table from casino parameter database 328 stored in data storage device 320 shown in FIG. 3;

DETAILED DESCRIPTION

Introduction

Figure 1:
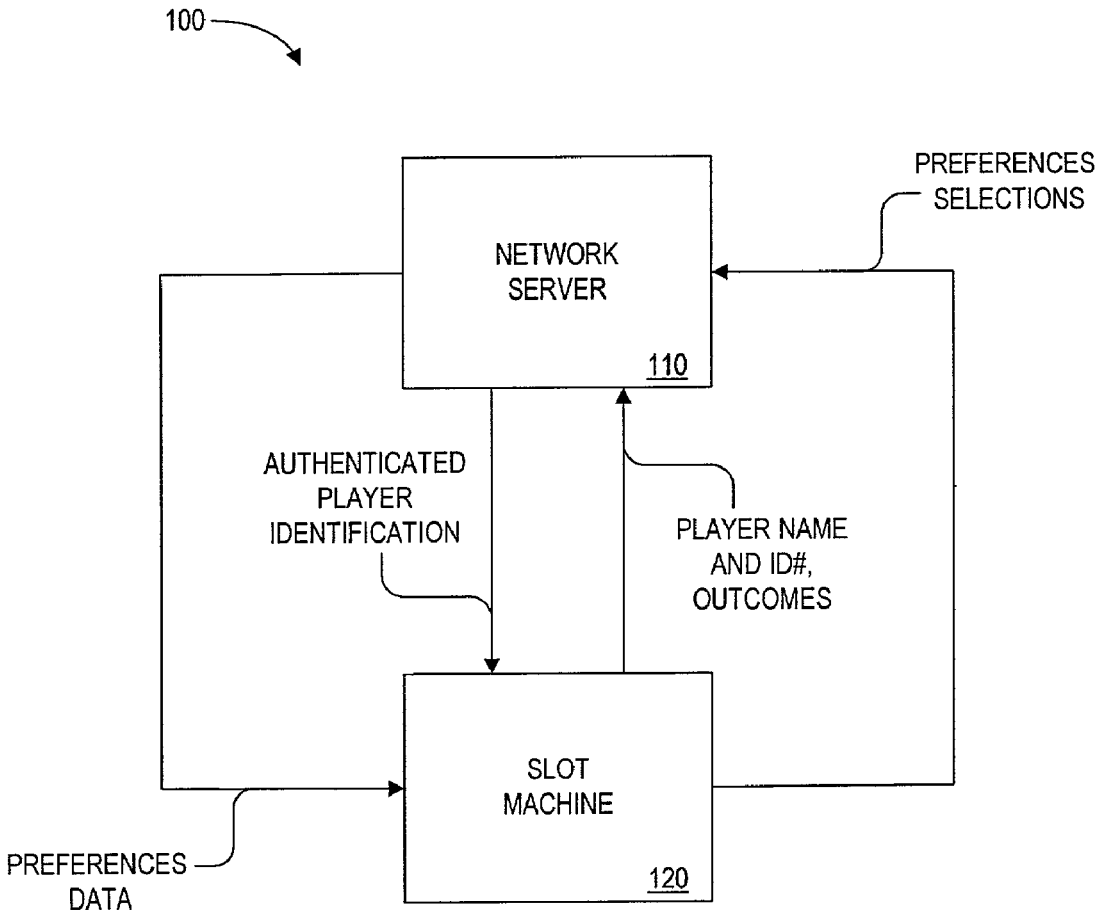
FIG. 1 is a block diagram of the system consistent with the invention.

Embodiments of the present invention allow casino players to customize the play of casino games, including table games and games played at slot machines, according to their playing preferences. Such systems may also tailor the play of casino games for individual players, for example, according to casino preferences. Such systems may eliminate the need for players to wander around a casino to locate a slot machine, slot machine game, or table game configured in the manner they prefer. Moreover, these systems allow casino games to be adapted to maintain the interest of the player.

Embodiments of the invention allow casino players to set player parameters easily, such as game type, language, and payout options, to preselected player preferences. In such systems, one or more casino devices (e.g., slot machines, other game devices, card readers, personal digital assistants (PDAs), data entry terminals, data display terminals) are networked to one or more central servers that store information about player preferences. As is known in the art, a central server comprises a computer or similar device that responds to requests from clients, such as casino devices. Such requests may be for data, programs, computations, processing or other resources the clients request. As is also known in the art, a central server may comprise a plurality of computers that work together and present the appearance of a single server to a client.

After a player provides a player identifier to the networked casino device (e.g., by inserting a player tracking card into a card reader device of a slot machine), the casino device transmits the player's identification number to the central server. The central server accesses and transmits player preferences associated with the received identification number to a casino device to configure play of a casino game for the player. The central server may also access and transmit other data associated with the received identification number, as described below.

The casino device receiving the player preferences does not have to be the same casino device that transmitted the player's identification number to the central server. The casino device receives the player preferences from the central server and configures the game to operate according to the received player preferences. Alternatively or in addition, casino personnel (e.g., table game dealer, slot host) may use the received player preferences to configure play of a casino game for the player. According to another alternative embodiment, the server configures the game to operate according to player preferences without transmitting the player preferences to the casino device.

Embodiments of the invention also allow casino devices to modify casino parameters, such as hold percentage, complimentary award rate, and game eligibility, to casino preferences according to the performance of casino players to enhance their play experience. The networked casino device transmits to the central server a player's identification number and performance data for a casino player. The central server receives the player identification number and performance data, determines appropriate casino preferences, and transmits the casino preferences to a casino device to configure play of a casino game for the player. The casino device receiving the player preferences does not have to be the same casino device that transmitted the player's identification number to the central server. The casino device receives the casino preferences from the central server and configures the game to operate according to the received casino preferences. Alternatively, casino personnel (e.g., table game dealer, slot host) may use the received player preferences to configure play of a casino game for the player. According to another alternative embodiment, the server configures the game to operate according to casino preferences without transmitting the casino preferences to the casino device.

A gaming system consistent with one embodiment of the present invention is adaptable to playing preferences and comprises a slot machine for allowing a player to bet on pseudo-randomized events and a central server. The slot machine includes a device for receiving preference data representing a preferred operation of the slot machine and a device for programming the slot machine to operate according to the received preference data. The server includes a device for storing a collection of data representing various operations of the slot machine and a device for selectively transmitting a portion of the stored collection of data to the slot machine as preference data. The server may also include a device for receiving data indicating a preferred operation of a slot machine.

In one embodiment, a server for configuring a slot machine to playing preferences comprises a device for storing a collection of data representing various operations of the slot machine and a device for selectively transmitting a portion of the stored collection of data to the slot machine as preference data. The server may also include a device for receiving data indicating a preferred operation of a slot machine.

In one embodiment, a game machine adaptable to playing preferences for allowing a player to bet on pseudo-randomized events controlled by the game machine comprises a device for receiving preference data representing a preferred operation of the game machine from an electronic storage medium and a device for configuring the game machine to operate according to the received preference data.

System

FIG. 1 illustrates a block diagram of a system 100 consistent with the present invention. System 100 includes network server 110 networked with slot machine 120. Although FIG. 1 shows only one slot machine 120, many slot machines are typically connected to network server 110. The term "slot machine" as used in this specification refers to any programmable gaming terminal controlling a random or pseudo-random event in which one or more players can bet on the outcome of the event.

Network server 110 may comprise conventional server computer hardware, such as an RS 6000 manufactured by IBM Corp. Server 110 executes software instructing the hardware to execute unique functions and operations in accordance with the principles of the invention. Slot machine 120 may comprise a conventional slot machine modified to carry out the functions and operations described below.

Network server 110 and slot machine 120 transmit digitally encoded data and messages to one another. The transmitted data preferably represents player name and identification number (or other player identifier), play results, authenticated player identification, preferences selections, and preferences data. Those having ordinary skill in the art will appreciate that the transmitted data need not be limited to the above. For example, transmitted data may relate to the time, to a message, to information about the casino, or to information about a hotel associated with the casino.

The terms "player identification number" and "player identifier" as used in this application refer to any identifier that may identify a player to the system 100. The player identifier does not necessarily have to be a number.

The communications link between server 110 and slot machine 120 preferably comprises a cable on which electronic signals can propagate. Alternatively, however, the communications link may comprise other conventional communications links, such as over-the-air broadcast transmission or any wireless transmission means.

Figure 2:
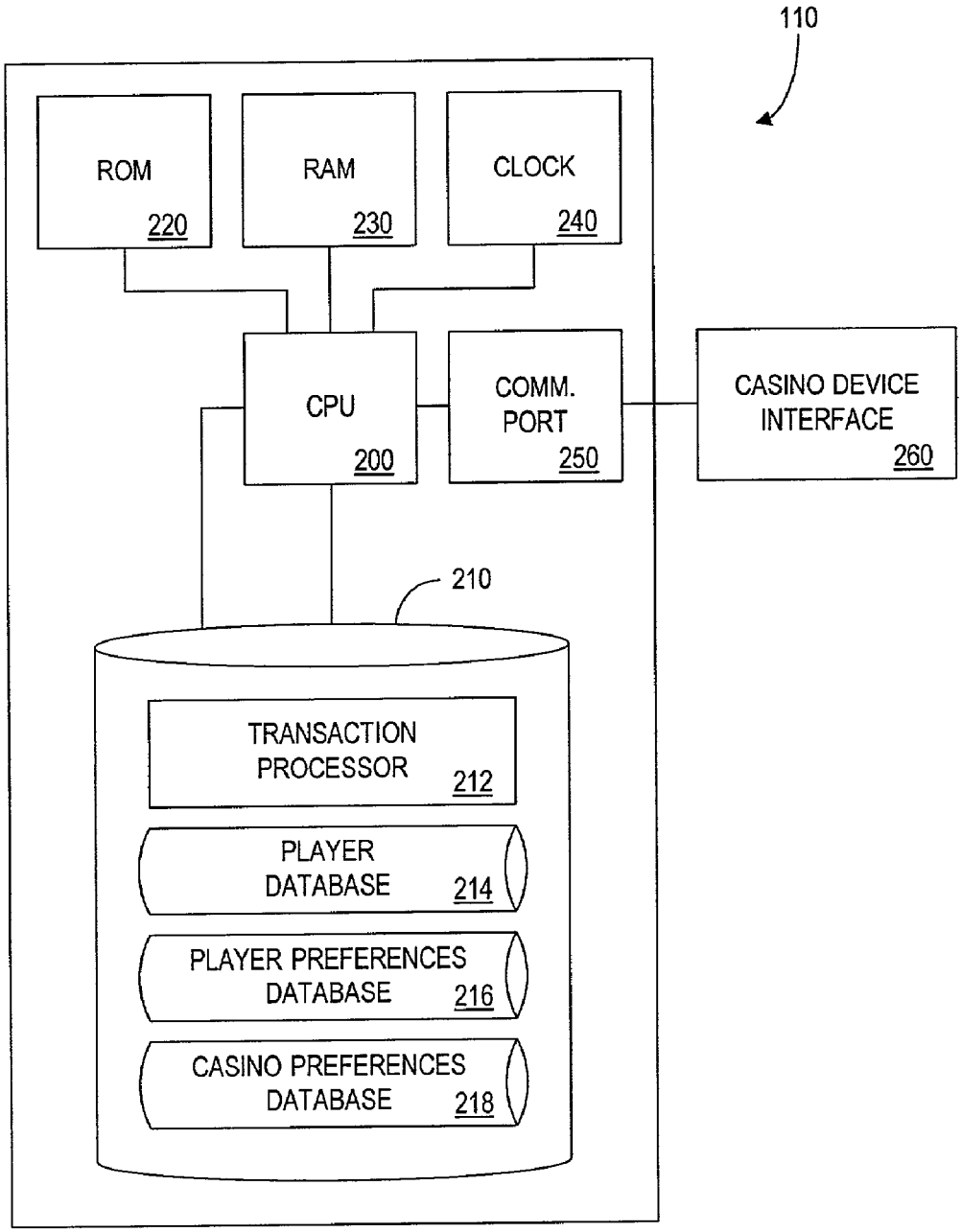
FIG. 2 is a block diagram of network server 110 shown in FIG. 1.

FIG. 2 is a block diagram showing the architecture of network server 110. Like other conventional server computers, network server 110 includes certain standard hardware components, such as CPU 200, storage device 210, ROM 220, RAM 230, clock 240, communications port 250. CPU 200 is linked to each of the other listed elements of FIG. 2. Communications port 250 connects network server 110 to casino device interface 260, which links network server 110 to slot machine 120. Alternatively, communications port 250 may connect network server 110 to another type of casino device, such as a card reader or a data terminal used by a dealer at a table game.

Network server 110 executes one or more programs to perform the functions and operations described below and stores one or more databases of data relating to those functions and operations. These databases include player database 214, player preferences database 216, and casino preference database 218. The programs (not shown) are preferably stored in storage device 210 and executed by CPU 200.

Transaction processor 212 accesses information to and from the databases in data storage device 210. Transaction processor 212 may comprise a separate, conventional CPU/microprocessor, as shown in FIG. 2, or alternatively comprise a portion of the operating function of CPU 200.

Player database 214 provides a repository of information on players. Players preferably receive casino player tracking cards from a casino by registering with the casino's card issuing authority. Alternatively, players may provide information to the casino without registering for or receiving a casino player tracking card. For example, a player at a slot machine may input information to the slot machine 120, as discussed further below, without registering for a player tracking card. FIG. 4 shows a possible organization of database 214 with the following information for each registered player: (1) player identification number, (2) social security number, (3) name, (4) address, (5) credit card number, (6) player rating, (7) complimentary (comp.) information, (8) player preference tracking number, and (9) casino preference tracking number. Player rating is preferably assigned by the casino and indicates the level of gambling activity of the player based upon, for example, the amount of money wagered per bet as well as the time played. Complimentary information for each player includes data indicating what free amenities, or "complimentaries," the casino has granted to the player as a reward for playing at the casino. Such amenities may include, for example, free drinks and meals at the casino, or a free room for the night in the casino hotel, or discounts for performances. Player preference tracking number and casino preference tracking number are unique identification numbers used to track the playing preferences of a player internally. In some embodiments, use of these tracking numbers may not be necessary. Player database 214 may, however, include fewer or more fields for player information.

Player preferences database 216 provides a table of information on player preferences indexed by player identification number. As shown in FIG. 5, database 216 preferably includes the following information on each registered player who entered player preferences through a slot machine: (1) player identification number, (2) game type, (3) language, (4) sound options, (5) speed of reel spins, (6) number of coins played per handle pull, (7) payout structure, (8) payout options, (9) form of complimentaries (comp.) and (10) currency type. Playing preferences generally relates to the values of those parameters that players have selected in establishing their preferred slot machine configuration. The playing preferences contained in database 216 include information about the preferred game (game type), the preferred configuration of the slot machine (language, sound options, speed of reel spins, number of coins played per handle pull), and preferred distribution of awards (payout structure, payout options, form of complimentaries, currency). In practice, fewer or more different types of player preferences can be stored in database 216.

Player preferences do not have to be entered through a slot machine. According to alternative embodiments of the present invention, selected preferences may be transmitted by the player to slot machine 120 or network server 110 via the Internet (e.g., by using the keyboard of a personal computer to input preferences into a form displayed at a web site), a telephone call (e.g., via an interactive voice response unit (IVRU)), or via a handheld device (e.g., a personal digital assistant (PDA)).

A player's preferences may also be determined by the slot machine 120 or network server 110 based on selections made by the player during game play. For example, the network server 110 may store an indication of the configuration used by the player the last time he played, or may determine a player's preferences based on the settings that the player has selected most often or on the games most often played.

Casino preferences database 218 contains a table of information on casino preferences indexed by player identification number. Casino preferences reflect certain parameters that casinos can adjust according to certain criteria, such as skill level or playing frequency, to maintain the interest of its players.

FIG. 6 shows a possible organization for database 218 with the following information on each registered player: (1) hold percentage, (2) complimentary award rate, (3) complimentary award limits, (4) game eligibility (lockout) and (5) other. Hold percentage indicates a range of hold percentages, such as high, medium, and low. Low hold percentages could, for example, be made available to "premium" customers (i.e., those with a high player rating.) because those players may be courted by competing casinos.

Complimentary rate indicates how often players should receive complimentary amenities. Complimentary award limit indicates the maximum number or volume of complimentary amenities each player should receive in a given time period (e.g., per night).

Game eligibility indicates whether each player is qualified to play certain games. For example, a casino may reserve particular machines for its most frequent players. Casino preferences database 218 would indicate which players qualify for such games.

The last field labeled "other" contains information representing other variables that can be modified to uniquely customize a game so that the player maintains interest. For example, this field may indicate that the number of player award points accumulated during a certain period of time should be increased by a multiplier to stimulate interest in the player's continued play of the slot machine. Alternatively, the "other" field may contain a stored player gambling history to develop a customized casino preferences and complimentary award program. Such a program would typically be developed to maintain a player's interest in continuing to play a game at a time when the history indicates he may otherwise stop. For example, where the player gambling history indicates that a player typically stops after losing a certain dollar value, the preferences and award program may be designed to improve his odds of winning as he approaches his typical stop value. In alternative embodiments, casino preferences database 218 may include more or fewer fields.

Figure 3:
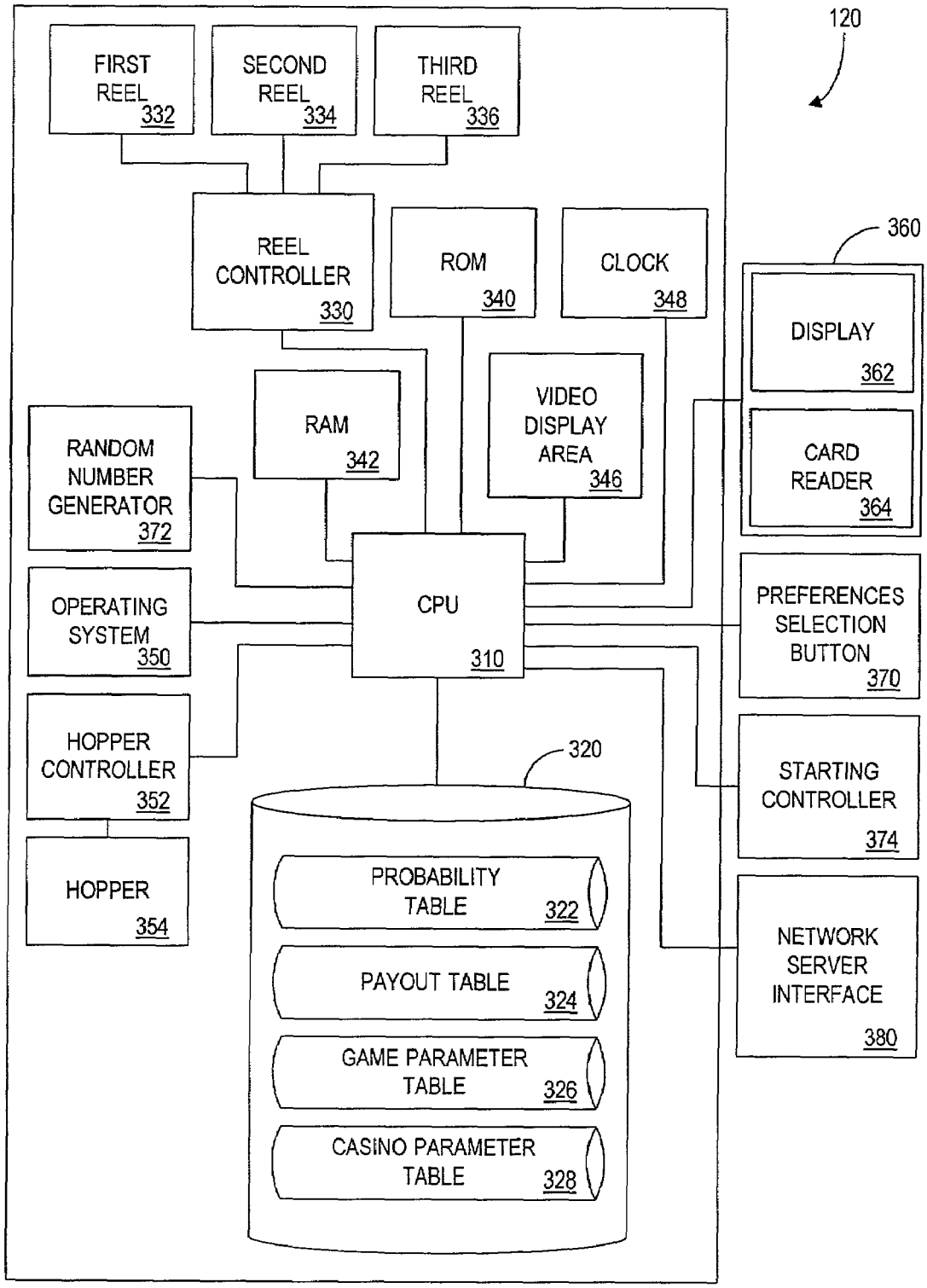
FIG. 3 is a block diagram of slot machine 120 shown in FIG. 1.

FIG. 3 shows the architecture of slot machine 120 according to one embodiment of the invention. Network server interface 380 provides a connection for linking slot machine 120 to network server 110. As shown in FIG. 3, slot machine 120 includes CPU 310, which is connected to data storage device 320, reel controller 330, ROM 340, RAM 342, video display area 346, clock 348, operating system 350, hopper controller 352, player card tracking device 360, preferences selection button 370, random number generator 372, starting controller 374, and network server interface 380. These components may be conventional. CPU 310 executes modules stored in storage device 320 to perform the functions and described below. Controller 330 is connected to three reels 332, 334, 336 for displaying symbols corresponding to payouts. Storage device 320 includes probability table 322, payout table 324, game parameters database 326, and casino parameter database 328.

With respect to gaming operations, slot machine 120 operates in a conventional manner. The player starts the machine by inserting a coin, or sing electronic credit, and pressing starting controller 374. Under control of a program stored, for example, in storage device 320 or ROM 340, CPU 310 initiates random number generator 372 to generate a number. CPU 310 looks up the generated random number in stored probability table 322 and finds the corresponding outcome. Based on the identified outcome, CPU 310 locates the appropriate payout in the stored payout table 324. CPU 310 also directs reel controller 330 to spin reels 332, 334, 336 and to stop them at a point when they display a combination of symbols corresponding to the generated outcome. When the player wins, the machine stores the credits in RAM 342 and displays them in video display area 346.

Hopper controller 352 is connected to hopper 354 for managing the flow of coins. When the player requests to cash out by pushing a button on slot machine 120, CPU 310 checks RAM 342 to see if the player has any credits and, if so, signals hopper controller 352 to release an appropriate number of coins into a payout tray.

In alternative embodiments, slot machine 120 does not include reel controller 330, and reels 332, 334, 336. Instead, video display area 346 graphically displays simulated representations of objects contained in the selected game, such as graphical reels or playing cards. These representations preferably animated or displayed to simulate playing of the selected game.

Player card tracking device 360 includes display 362 and card reader 364. Players insert player tracking cards into card reader 364. Tracking cards can be plastic cards with magnetic strips electronically storing respective player identification numbers. For example, a hotel key card or a credit card may be used as a tracking card. Display 362 displays information concerning the use of tracking device 360. Display 362 may be a touch screen display for receiving signals from the player concerning his selection of the options.

Alternatively, machine 120 or device 360 may include one or more separate input buttons (not shown) for the players to select the options and provide other input such as a PIN (personal identification number) or other player identifier that identifies a player. In other embodiments, slot machine 120 recognizes the identity of players through player identification devices other than player card tracking device 360, thereby eliminating the need for players to identify themselves using player identification cards. For example, slot machine 120 could include a keypad, at which players enter either their player identification numbers or their names along with a secured password. Slot machine 120 could also include a device for measuring player biometrics (i.e., facial features, fingerprint, voice, or retinal scan) to identify players.

Alternatively, preferences may be selected by the player issuing voice commands into a microphone (not shown) connected to slot machine 120 or inputting his preferences via a keypad (not shown) connected to slot machine 120.

Alternatively, machine 120 or device 360 may include one or more receivers (not shown) capable of receiving a signal that identifies a player, and also capable of receiving signals from the player concerning his selection of the options. For example, slot machine 120 could also include a device for receiving such signals from a communication device (not shown) such as a cellular telephone, handheld display device, or personal digital assistant (PDA).

Commercially available player card tracking devices include, for example, the Mastercom device available from Bally Manufacturing. (See, for example, U.S. Pat. No. 5,429,361 to Raven et al.). Such player tracking devices include a magnetic card reader and a numeric keypad for entry of player information.

Preferences selection button 370 allows a player to initiate selection of player preferences and to select player preferences displayed on video display area 346. Button 370 may comprise a conventional input device, such as a keyboard or dedicated buttons marked with appropriate labels.

Game parameter database 326 provides a table of information on game parameters that can be set in slot machine 120. Game parameters generally relate to those parameters that players may want to customize in their game playing.

FIG. 7 shows a possible organization for database 326 with the following information for slot machine 120: (1) game type, (2) language, (3) sound, (4) speed of reel spins, (5) currency, (6) payout type, (7) payout structure, (8) number of coins (default), and (9) form of complimentaries (comp.). Slot machine 120 selects values for each of the parameters from database 326 to configure operation of the game in slot machine 120. Slot machine 120 preferably cannot select values for the parameters that are not contained in database 326. Certain game parameter values stored in database 326 are designated as game default values and may be used when the player does not desire, or has not selected, player preferences. In alternative embodiments, database 326 includes different combinations of fewer or more player parameters.

Casino parameters database 328 provides a table of information on casino parameters that can be set in slot machine 120. Casino parameters generally relate to those parameters affecting awarding of payouts from slot machine 120. FIG. 8 shows a possible organization of database 328 with the following information for slot machine 120: (1) hold percentage, (2) complimentary rate, (3) comp. specifications, (4) game eligibility (lockout) and (5) other. Certain casino parameter values stored in database 328 are designated as game default values and may be used when the casino does not have established casino preferences for a player. Any of the listed casino parameters may be omitted or others included in database 328.

Operation of the System

The operation of system 100 will be described with respect to two different aspects. First, system 100 operates to adapt slot machine 120 to player preferences. Second, system 100 operates to adapt slot machine 120 to casino preferences. These operations may occur concurrently to adapt slot machine 120 to both player and casino preferences.

Adapting to Player Preferences

Figure 9:
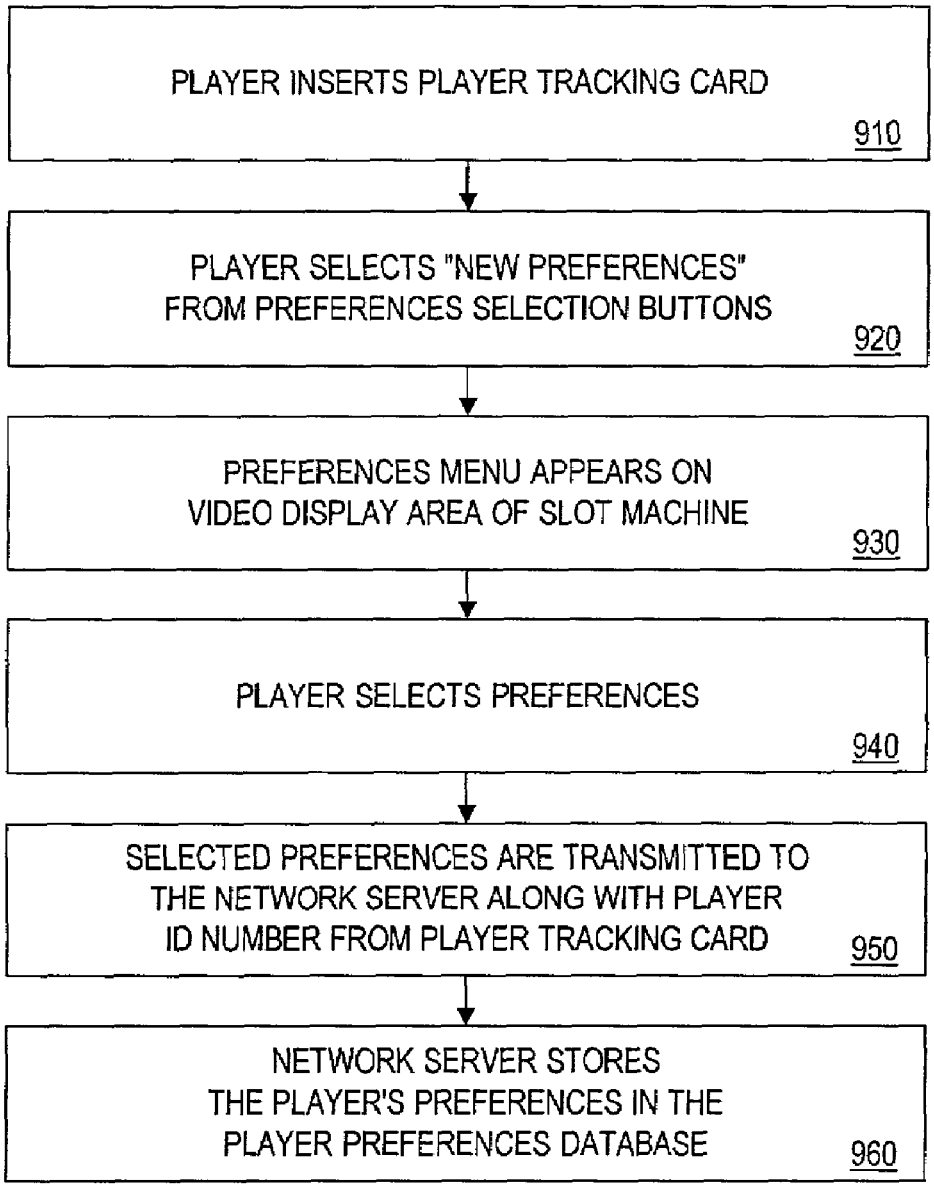
FIG. 9 is a flow diagram representing a method of establishing player preferences in a networked slot machine for later retrieval.

Before slot machine 120 can adapt to player preferences, the player must enter his preferences into system 100. FIG. 9 is a flowchart illustrating the steps in which a player enters his player preferences into system 100. As shown in FIG. 9, the player inserts his player tracking card into slot machine 120 (step 910). The player initiates entry of preferences by pressing the "New Preferences" button from preferences selection buttons 370 (step 920). Alternatively, the player may initiate entry of preferences simply by inserting his tracking card (or otherwise identifying himself) or inserting money into the slot machine 120. Video display area 346 displays a preferences menu providing a selection of different choices selectable by the player (step 930). The player selects his preferences using preferences selection button 370 (step 940), and slot machine 120 transmits the selected preferences, along with the player's identification number from his player tracking card, to network server 110 (step 950). Network server 110 stores the player's preferences in player preferences database 216 for later retrieval (step 960).

Figure 10A:
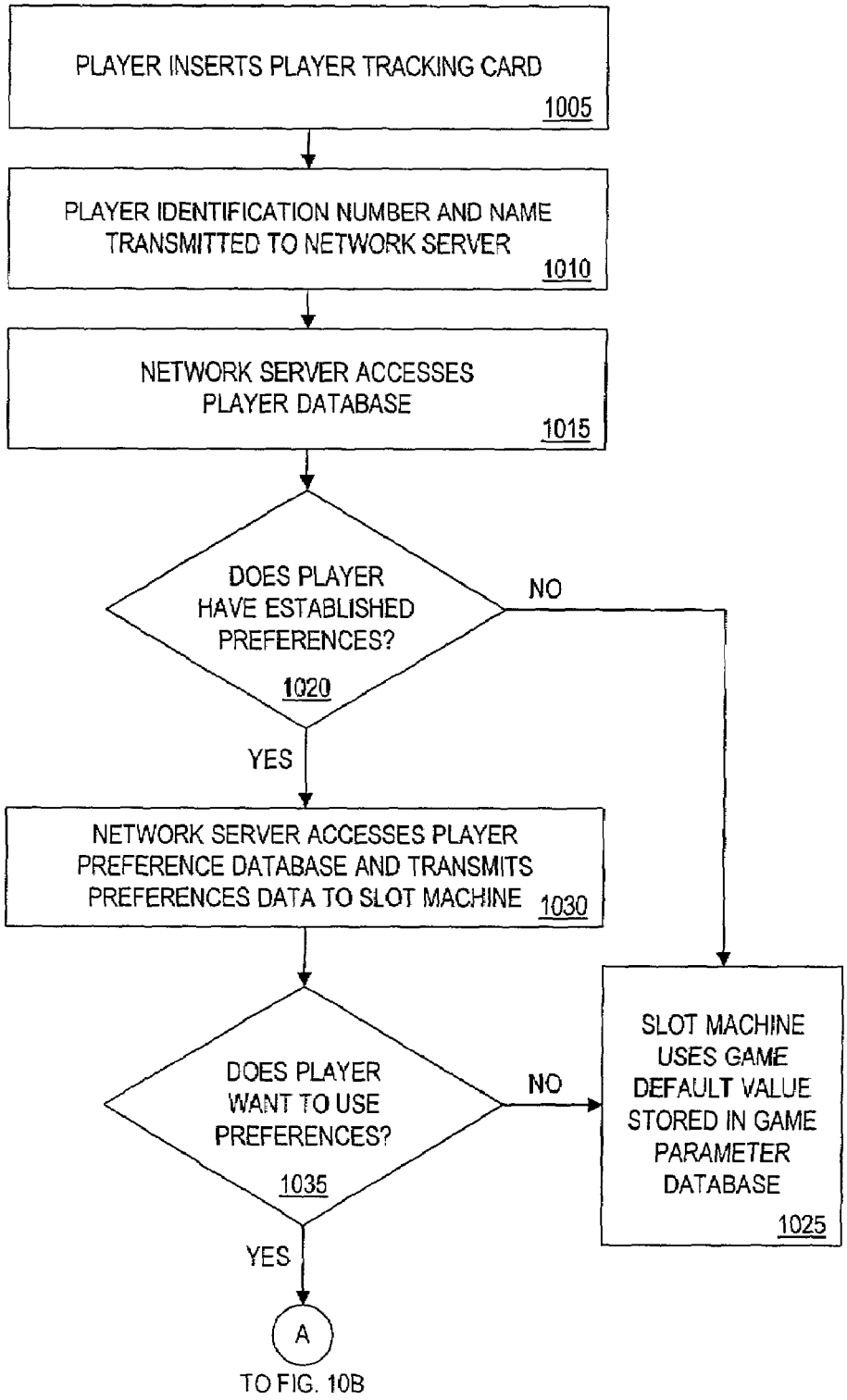
FIGS. 10*a*–10*b* are flow diagrams representing a method of configuring a slot machine based upon player preferences consistent with the invention.
Figure 10B:
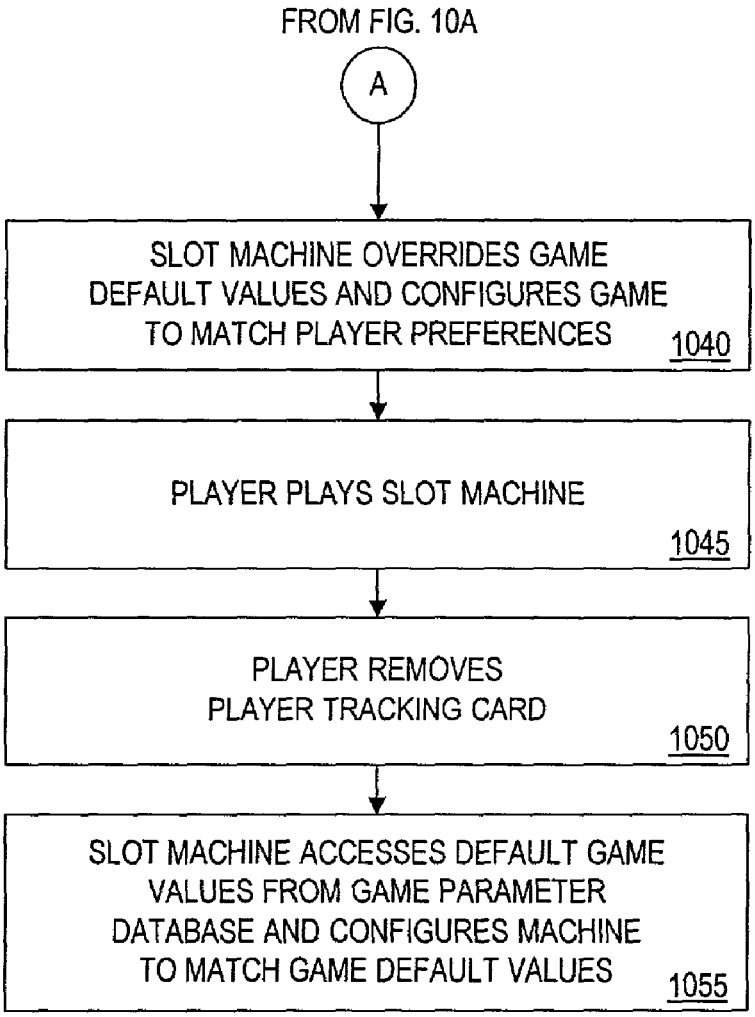

Once a player has selected his preferences, he may later retrieve them for configuring slot machine 120. FIGS. 10*a*–10*b* illustrate the manner in which system 100 retrieves player preference data to configure slot machine 120. As shown in FIG. 10*a*, the player inserts player tracking card into slot machine 120 (Step 1005), and slot machine 120 transmits the player identification number to network server 110 (step 1010). Although not shown, network server 110 may validate the player identification number by requiring that the player enter a PIN into slot machine 120.

Next, server 110 accesses the player database 214 (step 1015) and determines whether the player has previously established player preferences (step 1020). If not, server 110 informs slot machine 120, which retrieves game default values stored in game parameter database (step 1025). If the player does have established preferences (step 1020), network server 110 accesses player preferences database 216 and transmits the preferences data corresponding to that player's identification number to slot machine 120 (step 1030).

In one embodiment, server 110 transmits data actually representing the player preferences. In an alternative embodiment, server 110 transmits codes representing the player preferences, in which case slot machine 120 translates the received codes into player preferences using game parameter database 326. In another alternative embodiment, server 110 transmits a signal generated by the server 110 based on the player preferences. The signal is operative to configure play of the slot machine 120 according to the player preferences.

Slot machine 120 then queries the player whether to use previously established player preferences (step 1035). If not, slot machine 120 uses game default values stored in game parameter database 326 (step 1025). If the player indicates a desire to use his player preferences, slot machine 120 overrides the game default values and configures the game in slot machine 120 to match the player preferences (step 1040). Alternatively, slot machine 120 configures the game to the player's preferences without any input from the player. Alternatively, as described above, play of a game at slot machine 120 may be configured by a signal received from server 110.

Continuing to FIG. 10*b*, now that slot machine 120 is configured, the player plays the game on slot machine 120 (step 1045). When the player finishes, he removes the player tracking card from slot machine 120 (step 1050). Upon removal of the player tracking card, slot machine 120 accesses default game values from game parameter database 326 and configures the game in slot machine 120 to match the game default values (step 1055).

Adapting to Casino Preferences

Figure 11A:
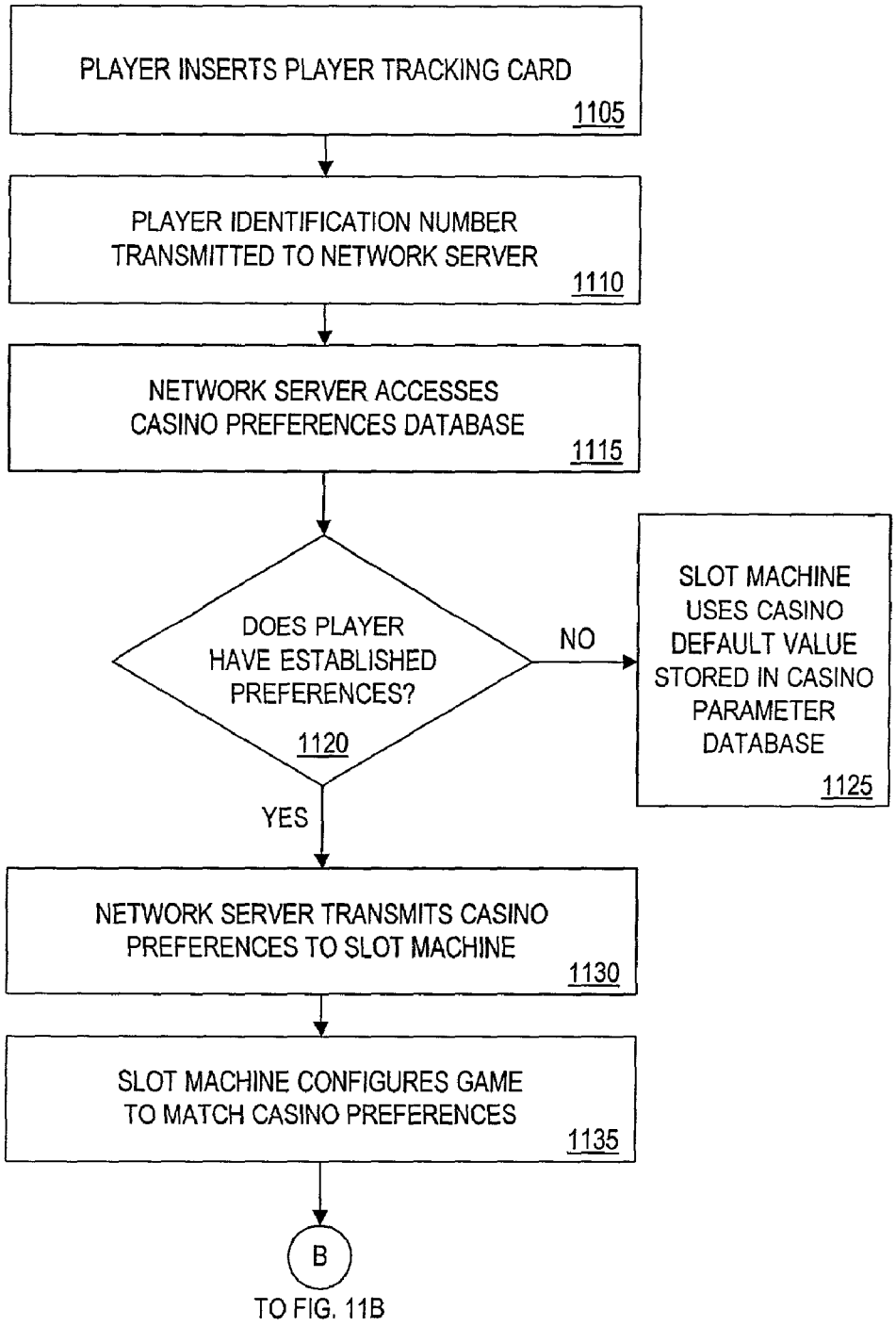
FIGS. 11*a*–11*b* are flow diagrams representing a method of configuring a slot machine based upon casino preferences consistent with the invention.
Figure 11B:
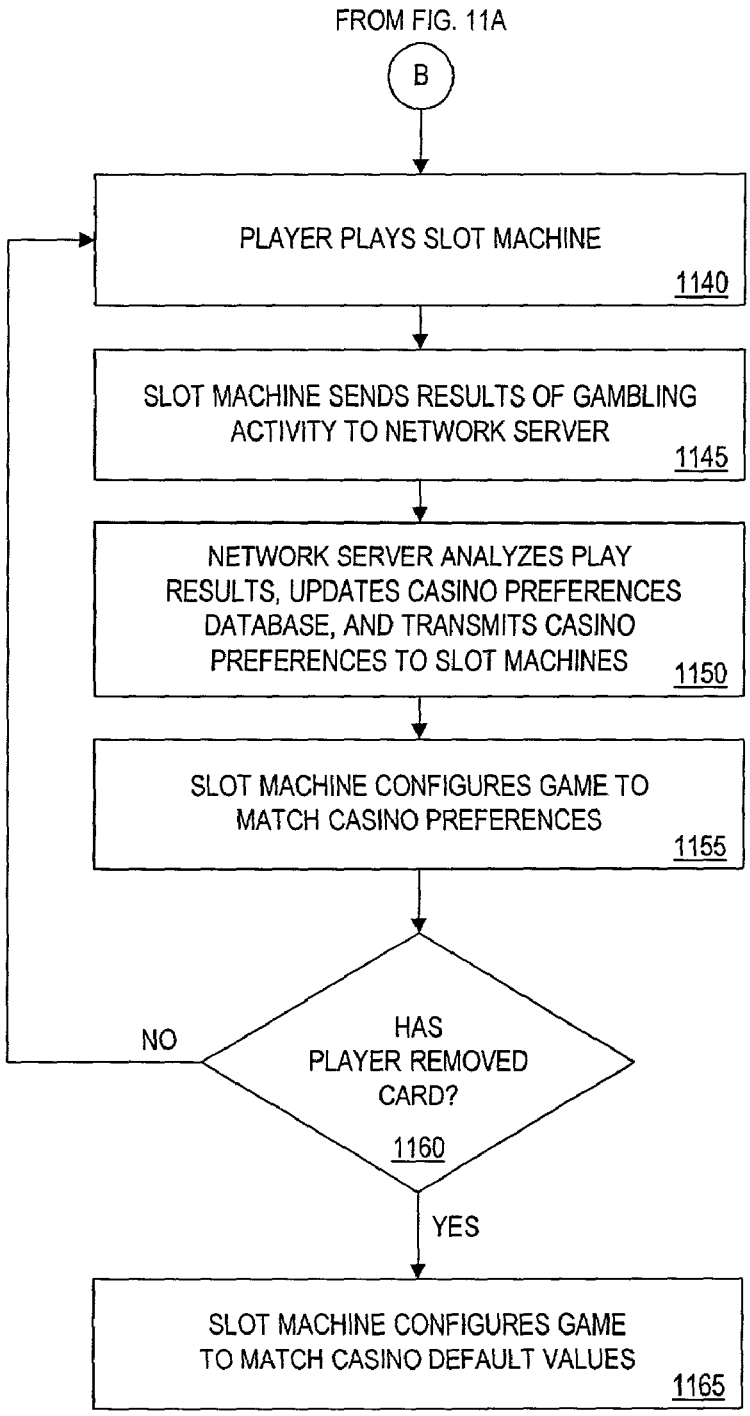

FIGS. 11*a*–11*b* illustrate the manner in which system 100 configures slot machine 120 to adapt to casino preferences. As shown in FIG. 11*a*, after the player inserts his player tracking card into slot machine 120 (step 1105), slot machine 120 transmits the player identification number to network server 110 (step 1110). Network server 110 accesses casino preferences database 218 (step 1115), and determines whether the player has established casino preferences (step 1120). If not, slot machine 120 uses casino default values stored in casino parameter database 328 (step 1125). If so, network server 110 transmits casino preferences to slot machine 120 (step 1130).

In one embodiment, server 110 transmits data representing the casino preferences. In another embodiment, server 110 transmits codes representing the casino preferences, in which case slot machine 120 translates the codes into the casino preferences using casino parameter database 328. In another alternative embodiment, server 110 transmits a signal generated by the server 110 based on the casino preferences. The signal is operative to configure play of the slot machine 120 according to the casino preferences.

Slot machine 120 configures the game to match the received casino preferences (step 1135). Alternatively, as described above, play of the game at slot machine 120 may be configured by a signal received from server 110.

Continuing to FIG. 11*b*, the player plays slot machine 120, as configured above (step 1140). The slot machine 120 sends the results of the gambling activity (i.e., the amount of money spent by the player and the amount of money won by the player) to network server 110 (step 1145). Network server 110 analyzes the play results; updates casino preferences database 216 as necessary; and transmits the updated casino preferences to slot machine 120 (step 1150).

Server 110 preferably establishes casino preferences by applying the received play results to predetermined rules. These rules may consider, for example, the skill of the player or the amount of money spent before the player quits. These rules are preferably designed to adjust casino parameters to stimulate the player's interest in continuing to play slot machine 120. Server 110 also calculates and stores any complimentary awards due the player.

Slot machine 120 next configures the game to match the received casino preferences (step 1155), and determines whether the player has removed his card (step 1160). If not, steps 1140–1155 are repeated. If the player has removed his card, slot machine 120 configures the game to match casino default values (step 1165).

Alternative Embodiments

Although the system has been described as one or more slot machines networked to a central server, the invention applies to other games, casino games, and gaming environments. For example, the invention can be applied to table games, such as blackjack and craps. Players insert their player tracking cards into card readers corresponding to seats around, for example, a blackjack table. As discussed above, alternative means may be used to identify the players. The central server could access player preferences data and casino preferences data for the players, and transmit that data to a data terminal or other casino device located at the dealer. The dealer could then modify the game or award payouts according to the preferences.

The invention also could apply to other environments or systems involving one or more data terminals networked to a central server to configure the terminals to identifiable users or operators. For example, the invention could be applied to networked video game systems, systems with point-of-sale terminals, and automatic teller machines (ATM). This eliminates the need for users or operators to manually enter information during each and every session to configure the terminals.

Further, player preferences data may be stored entirely on the player tracking card, rather than a central server. In such an embodiment, a machine reads the player preferences data from a received player tracking card and stores updated player preferences data on the card. In this way, player preferences move from machine to machine with the player's use of the card. Casino preferences may be added to the card periodically by, for example, temporarily providing the card to casino personnel for this purpose.

Alternative identifiers for identifying a player include: a physical characteristic (e.g., using a video camera to determine identity based on, for example, face, height, and/or stride), a credit card number, a smart card, a cell phone signal, an signal transmitted from a PDA or handheld device, a bar code, a serial number of currency used, a telephone number, a player-selected number or symbol, a room key and a room number.

As an alternative (or in addition to) storing multiple types of games at each slot machine or other casino device, multiple types of games could be stored at the network server. For example, when a different game is needed at a slot machine, based on stored player preferences or on selection by the player, the network server could transmit (or otherwise distribute) the game to the slot machine. Similarly, fonts, languages, pay tables and other data typically stored at each networked casino device could be stored at the network server and distributed as needed. By determining and distributing the necessary data to the slot machine in accordance with player preferences and/or casino preferences, the server could configure play of a casino game at the slot machine.

When a player terminates a game session (e.g., withdraws his player tracking identification card), the network server 110 may store an indication of the player's game progress. For example, in addition to storing an indication of the game configuration at the time play was terminated, the network server 110 may also store an indication of how many cherry symbols the player had collected, the displayed hand, or the number of levels of the game completed by the player. When the player begins game play again, the network server 110 may thus provide the player the option of continuing play of the game as if it had not been interrupted.

The casino device receiving the indication of playing preferences from the central server does not have to be the same casino device that the player used to identify himself to the system. For example, in the blackjack table game embodiment described above, the player may insert his player tracking card into a card reader at his seat, but the preference data corresponding to the player may be transmitted by the server to a data terminal viewed by the dealer. According to another example, the player may identify himself to the system upon checking into a hotel associated with the casino, or upon providing his identification information to a device on the slot floor. In response, an available slot machine is configured according to his preferences, and the player is then directed to the available slot machine.

Conclusion

It will be apparent to those skilled in the art that various modifications and variations can be made in the method and system of the present invention without departing from the spirit or scope of the invention. For example, the databases described above may reside in one or more databases stored in the data storage devices of either slot machine 120 or network server 110. The present invention covers the modifications and variations of this invention provided they come within the scope of the appended claims and their equivalents.

We claim:

1. A method comprising:

determining a player identifier that identifies a player of a casino device, the casino device operable to conduct a wagering game;

determining, based on the player identifier, a sound option preferred by the player; and generating at least one signal based on the sound option, the at least one signal being operable with the casino device to configure a sound feature of the casino device, such that the sound feature may be configured differently for different players playing the same game on the casino device.

2. The method of claim 1, in which the casino device is associated with a table game.

3. The method of claim 1, in which the casino device is a slot machine.

4. The method of claim 1, wherein determining the sound option preferred by the player comprises:

determining a sound option designated by the player as a preferred sound option.

5. The method of claim 1, wherein determining the sound option preferred by the player comprises:

determining data derived based on at least one setting the player has selected during game play that occurred prior to current game play; and determining the sound option based on the data.

6. The method of claim 1, further comprising:

transmitting the at least one signal to the casino device.

7. The method of claim 1, wherein determining a player identifier comprises:

receiving, from a gaming device, an indication of a player identifier that identifies a player currently playing the gaming device.

8. The method of claim 1, wherein determining the sound option preferred by the player comprises:

communicating with a remote controller, the remote controller storing data indicative of the sound option preferred by the player, to determine, based on the player identifier, the sound option preferred by the player.

9. A gaming device, comprising:

a communication port operable to facilitate communication among the gaming device and a server device associated with the gaming device;

a processor operable to facilitate a wagering game;

a memory storing data associated with the wagering game; and a player tracking module, the player tracking module operable to determine a unique identifier identifying a player currently playing the gaming device;

wherein the processor is operable with at least one of the player tracking module and the communication port to:

determine a player identifier that identifies a player of the gaming device;

determine, based on the player identifier, a sound option preferred by the player; and generate at least one signal based on the sound option, the at least one signal being operable with the gaming device to configure a sound feature of the gaming device, such that the sound feature may be configured differently for different players playing the same game on the gaming device.

10. The gaming device of claim 9, wherein the gaming device is associated with a table game.

11. The gaming device of claim 9, in which the gaming device is a slot machine.

12. The gaming device of claim 9, wherein the processor being operable to determine the sound option preferred by the player comprises the processor being operable with at least one of the player tracking module and the communication port to:

determine a sound option previously designated by the player as a preferred sound option.

13. The gaming device of claim 9, wherein the processor being operable to determine the sound option preferred by the player comprises the processor being operable with at least one of the player tracking module and the communication port to:

determine data derived based on at least one setting the player has selected during game play that occurred prior to current game play; and determining the sound option based on the data.

14. The gaming device of claim 13, wherein the prior game play was conducted on a second gaming device.

15. The gaming device of claim 9, wherein the processor being operable to determine the sound option preferred by the player comprises the processor being operable with at least one of the player tracking module and the communication port to:

communicate with the server device, the server device storing data indicative of the sound option preferred by the player, to determine, based on the player identifier, the sound option preferred by the player.

16. A system comprising:

a server device operable to communicate with a plurality of gaming devices, wherein each of the gaming devices is operable to conduct a wagering game; and the plurality of gaming devices;

wherein the server device is further operable to:

determine a player identifier of a player currently playing one of the plurality of gaming devices;

determine, based on the player identifier, a sound option preferred by the player; and generate at least one signal based on the sound option, the at least one signal being operable with the gaming device to configure a sound feature of the gaming device, such that the sound feature may be configured differently for different players playing the same game on the gaming device.

17. The system of claim 16 wherein the server device is further operable to:

transmit the signal to the gaming device, the signal indicating the sound option preferred by the player.

18. The system of claim 16, wherein the server device being operable to determine a sound option preferred by the player comprises the server device being operable to:

determine a sound option previously designated by the player as a preferred sound option.

19. The system of claim 16 wherein the server device being operable to determine a sound option preferred by the player comprises the server device being operable to:

determine data derived based on at least one setting the player has selected during game play that occurred prior to current game play; and determining the sound option based on the data.

20. The system of claim 19 wherein the prior game play occurred on a gaming device different from the gaming device the player is currently playing.

21. A computer usable medium having a computer readable program embodied therein for causing a processor of a computer to perform a method, the method comprising:

determining a player identifier that identifies a player of a casino device, the casino device operable to conduct a wagering game;

determining, based on the player identifier, a sound option preferred by the player; and generating at least one signal based on the sound option, the at least one signal being operable with the casino device to configure a sound feature of the casino device, such that the sound feature may be configured differently for different players playing the same game on the casino device.

* * * * *